US006517427B1

(12) United States Patent
Yoshikawa et al.

(10) Patent No.: US 6,517,427 B1
(45) Date of Patent: Feb. 11, 2003

(54) ABRASIVE-BLADED MULTIPLE CUTTING WHEEL ASSEMBLY

(75) Inventors: Masao Yoshikawa, Takefu (JP); Takehisa Minowa, Takefu (JP)

(73) Assignee: Shin-Etsu Chemical Co., Ltd. (JP)

( * ) Notice: Subject to any disclaimer, the term of this patent is extended or adjusted under 35 U.S.C. 154(b) by 353 days.

(21) Appl. No.: 09/028,059

(22) Filed: Feb. 23, 1998

(51) Int. Cl.[7] ..... B24D 5/02
(52) U.S. Cl. ..... 451/547; 451/544
(58) Field of Search ..... 451/547, 544

(56) References Cited

U.S. PATENT DOCUMENTS

| | | | | | |
|---|---|---|---|---|---|
| 3,898,772 | A | * | 8/1975 | Sawluk | 51/206 P |
| 4,188,755 | A | * | 2/1980 | Fitzpatrick | 51/206 P |
| 4,208,843 | A | * | 6/1980 | Amaki et al. | 51/207 |
| 4,457,113 | A | * | 7/1984 | Miller | 51/206 R |
| 4,592,169 | A | * | 6/1986 | Klievoneit et al. | 51/118 |
| 5,035,087 | A | * | 7/1991 | Nishiguchi et al. | 51/131.1 |
| 5,313,742 | A | * | 5/1994 | Corcoran, Jr. et al. | 51/206 R |
| 5,505,750 | A | * | 4/1996 | Andrews | 51/309 |
| 5,573,447 | A | * | 11/1996 | Kozakai et al. | 451/41 |

FOREIGN PATENT DOCUMENTS

EP 559006 9/1993

OTHER PUBLICATIONS

European Search Report with Annex to the European Search Report on European Pat. Appln. No. EP 98301438.
Patent Abstracts of Japan, vol. 97, No. 11, Nov. 28, 1997, JP 09 174441A.

* cited by examiner

*Primary Examiner*—William Hong
(74) *Attorney, Agent, or Firm*—Dennison, Schultz & Dougherty

(57) ABSTRACT

Provided is an abrasive-bladed multiple cutting wheel assembly composed of a plurality of abrasive-bladed cutting wheels and spacers each between two adjacent cutting wheels to define the spacing therebetween on a rotation shaft. While each of the cutting wheels consists of an annular base wheel provided on the outer periphery thereof with an abrasive blade layer containing particles of an abrasive such as diamond particles, the base wheels in the inventive assembly are made from a cemented metal carbide such as tungsten carbide cemented with cobalt having a specified Young's modulus or specified Vickers hardness Hv instead of conventional steel materials so that the thickness of the base wheel can be as small as 0.1 mm and, despite the very small thickness of the base wheel, the cutting wheel assembly serves for the cutting or slicing works of a very hard and brittle material such as sintered rare earth-based permanent magnets with outstandingly high cutting accuracy and durability.

8 Claims, 2 Drawing Sheets

ABRASIVE-BLADED MULTIPLE CUTTING WHEEL ASSEMBLY

BACKGROUND OF THE INVENTION

The present invention relates to an abrasive-bladed or, in particular, to a diamond-bladed multiple cutting wheel assembly. More particularly, the invention relates to an assembly of a plurality of cutting wheels each bladed on the outer periphery of a base wheel with abrasive particles such as diamond particles and held coaxially on a single shaft by keeping an appropriate space from the adjacent cutting wheels so as to prepare a plurality of machine-cut pieces from a single base block of a hard and brittle material such as sintered magnets of a rare earth-based alloy at a single run of the cutting work.

In an industrial process for the preparation of a large number of, e.g., sintered rare earth-based magnet pieces of the same dimensions, it is alternative that the magnet pieces are prepared one by one in a powder metallurgical process including the steps of powder molding into a green powder compact and sintering of the green body or that a large magnet block is prepared by the powder metallurgical method and the large block is subsequently sliced or cut by using a suitable cutting tool into pieces by taking into account the axis of easy magnetization of the magnet when the sintered magnet is anisotropically magnetic.

In the former process of individual production of magnet pieces one by one repeating a unit powder metallurgical process for a single product, the only requirement for the process is that the single product by the unit process is acceptable and good reproducibility of the process can be ensured with high productivity so that the mechanical working of the sintered pieces can be relatively simple and easy although such an individual process is not suitable for the manufacture of small magnet pieces or magnet pieces of a small thickness in the direction of magnetization because deformation of small pieces or warping of a thin sheet is unavoidably very large relative to the planar dimensions sometimes not to give any acceptable products. These problems are no longer of great significance in the latter process of machining of a large magnet block in which the process control can be undertaken relatively simply for the powder molding and sintering steps so that this process is of the major current of the rare earth magnet production due to the high productivity and good versatility. On the other hand, what is important in this process is the productivity of the machining step of the large sintered magnet blocks obtained by sintering with dimensional accuracy as high as possible and with a material loss as small as possible.

The most widely employed cutting tools for this purpose are abrasive-bladed cutting wheels which can be either of the internal-bladed type or outer-bladed type. An internal-bladed cutting wheel bladed with abrasive particles is an integral body formed from a thin annular base wheel provided with a cutting blade of abrasive particles on and along the inner periphery of the annular base wheel. An outer-bladed cutting wheel is, as is illustrated in FIGS. 1A, 1B and 1C, an integral body 6 formed from a thin disk 1 as the base wheel having a shaft opening 5 and provided with a cutting blade 2 of abrasive particles on and along the outer periphery of the base wheel 1. As a trend in recent years, the outer-bladed cutting wheels are preferred to the internalbladed cutting wheels. The outer-bladed cutting wheels are still more advantageous with a multiplied productivity of the cutting works when a plurality of such cutting wheels 6 are, as is illustrated in FIGS. 2A and 2B by a perspective view and an axial cross sectional view, respectively, assembled coaxially on a single shaft 10 with spacers 3 each between two adjacent cutting wheels 6 enabling to produce a plurality of magnet pieces as cut or sliced in a single run of the cutting works.

The above mentioned abrasive particles are preferably particles of diamond or cubic boron nitride when the material of the workpiece is a sintered rare earth-based magnet alloy. The abrasive particles are bonded or cemented together to form the cutting blade 2 on the outer periphery of the base wheel 1 by the resin-bond method using a resinous bonding agent, metal-bond method using a metallic cementing agent or electrodeposition method forming a metallic plating layer on the surface of the abrasive particles, of which the resin-bonded cutting blades are preferred in the cutting works of a rare earth-based magnets or, in particular, sintered magnets of a rare earth-iron-boron alloy as a high-hardness material. This is because the holding strength on the resin-bonded abrasive particles is less firm due to the lower mechanical strengths of the resinous bonding agent as compared with metallic cementing agents but the low elastic modulus of the resinous bonding agent ensures a soft-touch condition between the workpiece and the abrasive particles and lastingly excellent quality of cutting. In a metal-bonded cutting wheel of abrasive particles, namely, the particle-holding strength and the wearing resistance of the cutting blade layer can be high due to the high mechanical strengths and high elastic modulus of the metallic cementing agent while these advantages are accompanied by a disadvantage that the abrasive surface of the cutting blade layer readily becomes dull to exhibit an increased cutting resistance although cutting wheels with a metal-bonded abrasive blade are also used in the cutting works of rare earth-iron-boron sintered magnet blocks, though not so widely practiced.

In conducting multiple cutting of a large rare earth magnet block by using a multiple cutting wheel assembly illustrated in FIGS. 2A and 2B to obtain a plurality of magnet pieces as cut or sliced in a single cutting run, one of the most important factors to be taken into consideration besides the accuracy of the cutting work is the relationship between the thickness of the abrasive-bladed cutting wheels and the material loss of the sintered rare earth magnet because a larger thickness of the abrasive-bladed cutting wheels necessarily results in an increase in the material loss by cutting and a decrease in the number of magnet piece products leading to a decrease in the productivity and increase of the production costs.

When the thickness of the abrasive cutting blade 2 is desired to be decreased in order to decrease the material loss of the rare earth magnet, it is of course that the thickness of the base wheel 1 must also be as small as possible while thickness of the base wheel 1 is limited depending on the material thereof. In view of the low costs and high mechanical strengths, the material of base wheels in conventional abrasive-bladed cutting wheels is almost exclusively limited to alloy tool steels including the grades of SK, SKD, SKT and SKH specified in JIS (Japanese Industrial Standard). When an abrasive-bladed cutting wheel with a steel-made base wheel is employed in the cutting work of a very hard material such as sintered rare earth magnets, however, the mechanical strength of the base wheel is still insufficient so that troubles are sometimes encountered such as distortion and warping of the cutting wheel to adversely affect the dimensional accuracy of the magnet pieces as cut or sliced.

Furthermore, a serious difficulty is encountered when the thickness of the base wheel of an abrasive-bladed cutting wheel is decreased. As is shown in FIG. 1C illustrating an enlarged axial cross sectional view of the abrasive cutting blade 2 bonded to the outer periphery of a base wheel 1, it is usual that the thickness t2 of the abrasive blade is larger than the thickness t1 of the base wheel 1 so that, when the abrasive blade 2 cuts into a workpiece, a gap space called an "escape" having a thickness t3, which is usually in the range from 0.01 to 0.2 mm, is formed between the surface of the base wheel 1 and the workpiece under cutting. This escape serves as a discharge passage of cutting dust particles from the surface of the base wheel 1 which must be discharged as smoothly as possible by increasing the thickness t3 while the thickness t3 should be as small as possible in order to decrease the material loss caused by the cutting works.

Namely, the difficulty encountered in the use of a cutting wheel made from a base wheel 1 of a small thickness t1 is that the thickness t2 of the abrasive blade and, consequently, the thickness t3 of the escape cannot be large enough to ensure smoothness in the discharge of cutting dust and abrasive particles off the blade 2 so that the surface of the base wheel 1 is heavily scratched and damaged by the particles jammed in the gap space of the escape. This problem is particularly serious when the workpiece under machining is a rare earth-based sintered magnet block because a sintered rare earth magnet has a hardness equivalent to or even higher than that of the alloy tool steels conventionally used as a material of the base wheel in abrasive-bladed cutting wheels of the prior art along with remarkable brittleness resulting in heavy damages on the surface of the base wheel 1. Once the surface of the base wheel 1 has abrasive scratches with local plastic deformation, the base wheel 1 loses balance of stress between the two surfaces resulting in deformation of the base wheel 1 such as warping and undulation. This disadvantage is more serious when the thickness of the base wheel 1 is smaller to cause large warping or undulation even with very small scratches. Any small deformation in the base wheel 1 has an effect to further enlarge warping and undulation of the base wheel 1 by the stress in further cutting runs acting toward this effect so that the dimensional accuracy of the workpieces as cut or sliced is greatly decreased.

When the cutting work is conducted by using a multiple cutting wheel assembly illustrated in FIGS. 2A and 2B with a plurality of abrasive-bladed cutting wheels 6 as supported coaxially on a single shaft 10 keeping a space from the adjacent wheels 6 with spacers 3, in particular, the dimension, e.g., thickness, of the workpiece as cut or sliced is determined solely by the spacings between two adjacent cutting wheels so that any slightest warping or undulation of the base wheels 1 directly affects the dimensional accuracy of the products as cut or sliced unless the spacing between the cutting wheels 6 or, namely, the thickness of the spacers 3 is frequently adjusted resulting in a great decrease in the productivity of the cutting works or undue increase of the material loss by cutting.

SUMMARY OF THE INVENTION

The present invention accordingly has an object to provide a novel abrasive-bladed multiple cutting wheel assembly without the above described problems and disadvantages in the prior art assemblies of the similar type.

Thus, the abrasive-bladed multiple cutting wheel assembly provided by the invention is an assembly which comprises:

(A) a shaft for rotation;

(B) at least two abrasive-bladed cutting wheels each consisting of a base wheel having a center opening for insertion of the shaft, of which the diameter is not exceeding 200 mm and the thickness is in the range from 0.1 to 1 mm, and an abrasive blade layer bonded to the outer periphery of the base wheel, each cutting wheel being fixed on the shaft inserted into the center opening in the base wheel; and (C) at least one spacer, the number of the spacers being smaller by one than the number of the cutting wheels, each having a center opening for insertion of the shaft and fixed on the shaft by inserting the shaft into the center opening at a position between two abrasive-bladed cutting wheels to define the spacing therebetween, the base wheel of the abrasive-bladed cutting wheel being made from a cemented metal carbide and the abrasive blade layer of the abrasive-bladed cutting wheel being made from particles of an abrasive material bonded together with a bonding agent.

In particular, the base wheel made from a cemented metal carbide should have a Young's modulus in the range from 45000 to 70000 kgf/mm$^2$ or, alternatively, should have a Vickers hardness Hv in the range from 900 to 2000.

Further, the abrasive particles from which the blade layer is formed are preferably particles of diamond, particles of cubic boron nitride or a combination thereof having an average particle diameter in the range from 50 to 250 $\mu$m and the volume fraction of the abrasive particles in the blade layer is preferably in the range from 10 to 50%, the balance being the bonding agent.

DETAILED DESCRIPTION OF THE PREFERRED EMBODIMENTS

Figure 1A:
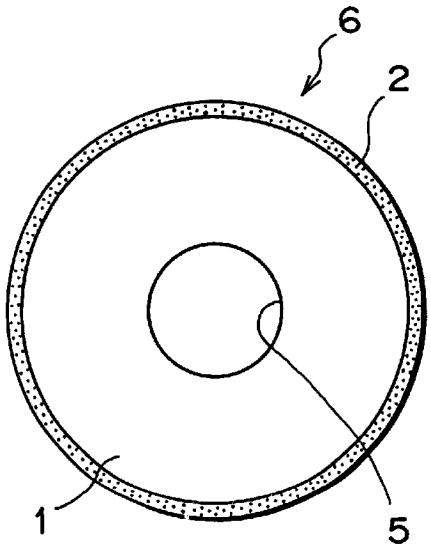
FIG. 1A is a plan view of a single abrasive-bladed cutting wheel as a part of the inventive assembly.

The above defined multiple-bladed cutting wheel assembly according to the present invention has several essential or optional features described below.

(1) The base wheel of each of the outer-bladed cutting wheels forming the assembly is made from a cemented metal carbide having a Young's modulus in the range from 45000 to 70000 kgf/mm$^2$ or, alternatively, a Vickers hardness Hv in the range from 900 to 2000.

(2) The base wheel has an outer diameter not exceeding 200 mm and a thickness in the range from 0.1 to 1 mm.

(3) The assembly has at least two or, preferably, at least three abrasive-bladed cutting wheels and, correspondingly, at least one spacer sandwiched between two adjacent cutting wheels to define the spacing therebetween. The number of the cutting wheels in one assembly can be as large as 200.

(4) The abrasive particles contained in the abrasive blade layer are preferably particles of diamond or cubic boron nitride as well as a combination thereof having an average particle diameter in the range from 50 to 250 $\mu$m and the volume fraction of the abrasive particles in the abrasive blade layer is in the range from 10 to 50%, the balance being a bonding agent.

(5) The abrasive blade layer has a thickness larger by 0.02 to 0.4 mm than the thickness of the base wheel to give an escape of 0.01 to 0.2 mm on each side of the base wheel.

Figure 1B:
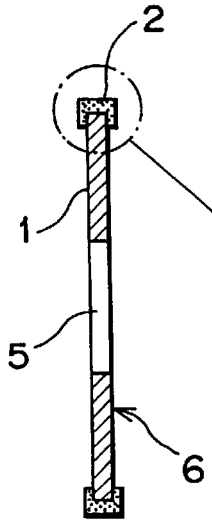
FIG. 1B is an axial cross sectional view of the cutting wheel illustrated in FIG. 1A

FIGS. 1A, 1B and 1B are each a plan view, an axial cross sectional view and an enlarged partial axial cross sectional view of the abrasive blade layer, respectively, of a single abrasive-bladed cutting wheel as a part of the inventive assembly.

The most characteristic feature of the inventive assembly is that the base wheel 1 of each of the abrasive-bladed cutting wheels 6 forming the assembly is made from a cemented metal carbide having a specified Young's modulus or, alternatively, having a specified Vickers hardness Hv. A cemented metal carbide is a material inherently having such a hardness and tenacity as to be used per se as a material of a cutting blade. In fact, cutting wheels made from a cemented metal carbide alone are under wide practical uses for the cutting works of various materials including wooden and masonry materials, fibrous materials, plastics and cigarette filters. In the inventive cutting wheel assembly, each of the cutting wheels 6 is a composite body consisting of a base wheel 1 made from a cemented metal carbide and an abrasive blade layer 2 formed on and around the outer periphery of the base wheel 1 while the abrasive cutting blade layer 2 is made from particles of an abrasive material such as particles of diamond and cubic boron nitride bonded together with a bonding agent in order that the multiple cutting wheel assembly can be used even in cutting or slicing of a material having an extremely high hardness such as sintered blocks of a rare earth-based alloy for permanent magnets.

When a high-hardness material such as rare earth-based magnet alloys is cut or sliced with a cutting wheel abrasive-bladed on the outer periphery of a base wheel, one of the most important factors affecting the results of the cutting work is the material of the base wheel. On the base of this understanding, the inventors have conducted extensive investigations for selecting a material of the base wheel of an abrasive-bladed cutting wheel which is free from the troubles due to warping or undulation of the base wheel under strong stress occurring in the course of the cutting works therewith leading to an unexpected discovery that a quite satisfactory result can be obtained by using an abrasive-bladed cutting wheel formed with a base wheel made from a cemented metal carbide even though the hardness of cemented metal carbide in general is lower than most of ceramic materials such as alumina. Ceramic-made base wheels cannot be used in a cutting wheel due to brittleness of ceramic materials in general to cause an extremely great danger because a ceramic-made base wheel is readily cracked and broken even with a small impact force during the cutting works of a hard workpiece such as sintered rare earth-based magnets.

Cemented metal carbide is a sintered body obtained by sintering of a powder mixture consisting of particles of a carbide of the metal belonging to Groups IVa, Va or VIa of the periodic table of chemical elements such as tungsten carbide WC, titanium carbide TiC, molybdenum carbide MoC, niobium carbide NbC, tantalum carbide TaC and chromium carbide $Cr_3C_2$ and particles of a metal or an alloy of metals such as iron, cobalt, nickel, molybdenum, copper, lead and tin to effect cementing of the metal carbide particles with the metal or alloy as the matrix phase. Examples of particularly suitable cemented metal carbides include those of tungsten carbide particles cemented with cobalt, tungsten carbide-titanium carbide mixed particles cemented with cobalt and tungsten carbide-titanium carbide-tantalum carbide mixed particles cemented with cobalt, though not particularly limitative thereto.

It is essential that the base wheel 1 made from a cemented metal carbide has a Young's modulus in the range from 45000 to 70000 kgf/mm$^2$ or, alternatively, a Vickers hardness Hv in the range from 900 to 2000. When the Young's modulus of the base wheel 1 is too low, the base wheel 1 is subject to occurrence of warping and undulation by the resistance force received during the cutting works with the multiple cutting wheel assembly so that the advantage of decreasing the thickness of the base wheel to be obtained by the use of a cemented metal carbide is lost. When the Young's modulus of the base wheel exceeds the above mentioned upper limit, on the other hand, such a high Young's modulus is necessarily accompanied by an increase of brittleness so that the base wheel may be subject to cracking and breaking during cutting works to cause a great danger. When the Vickers hardness of the base wheel is too low, the base wheel is scratched or damaged during the cutting works by the cutting dust particles jammed in the escape between the surface of the base wheel and the surface of the workpiece under cutting which may have a hardness approximating or sometimes exceeding the hardness of the base wheel resulting in eventual occurrence or promotion of warping and undulation of the base wheel. A Vickers hardness of the base wheel to exceed the above mentioned upper limit is sometimes accompanied by a decrease in the toughness of the material so that similar troubles are encountered to the use of a base wheel having an unduly high Young's modulus.

Figure 2A:
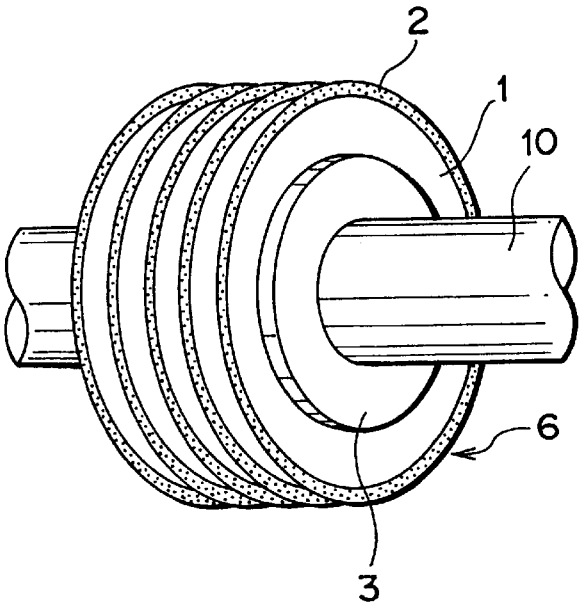
FIG. 2A is a perspective view of an abrasive-bladed multiple cutting wheel assembly with 5 cutting wheels.
Figure 2B:
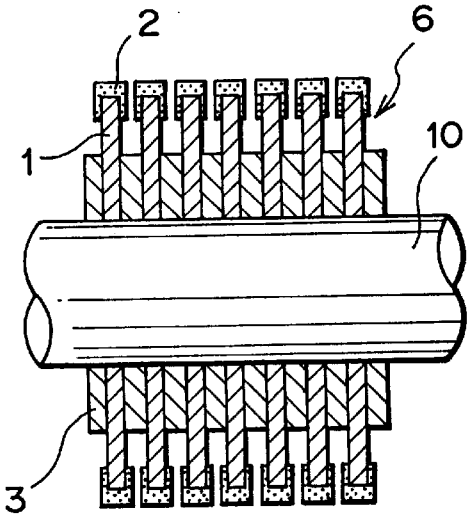
FIG. 2B is an axial cross sectional view of an abrasive-bladed multiple cutting wheel assembly with 7 cutting wheels.

The number of the abrasive-bladed cutting wheels 6 assembled to form a multiple cutting wheel assembly of the invention is from 2 to 200 or, preferably, from 3 to 200. The advantages obtained by the use of an assembly formed from only two cutting wheels are relatively small. When the number of the cutting wheels 6 is too large, the multiple cutting wheel assembly has an excessively large weight to cause a difficulty in handling of the assembly. The number of spacers 3, which are mounted on and fixed to the same shaft 10 as the cutting wheels 6 in an alternate order, is accordingly in the range from 2 to 199 because each of the spacers 3 is sandwiched between two cutting wheels 6 although it is optional that the cutting wheel 6 at the outermost position of the cutting wheel assembly is sandwiched between two spacers 3 as is illustrated in FIGS. 2A and 2B so that the number of the spacers 3 is larger by 1 than the number of the cutting wheels 6.

The abrasive blade layer 2 of each of the cutting wheels 6 is formed by bonding particles of an abrasive material such as diamond and cubic boron nitride by using a bonding agent. The method of bonding abrasive particles is not particularly limitative including resin bonding, metal bonding, vitrification bonding and electrodeposition bonding depending on the types of the bonding materials. By virtue of the high rigidity of the base wheel 1 made from a cemented metal carbide, even an abrasive blade layer formed by the method of metal bonding exhibiting the largest cutting resistance among the various bonding methods of abrasive particles ensures a high accuracy of cutting in the cutting works of a hard workpiece. Metal-bonded abrasive blade layers in general are advantageous as compared with resin-bonded abrasive blade layers in respect of the higher wearing resistance and consequently longer durability of the abrasive-bladed cutting wheels so that the multiple cutting wheel assembly of the invention can serve for the cutting works without disjointing the assembly into individual cutting wheels for re-dressing or replacement of the blade greatly contributing to the improvement in the productivity of the cutting works.

The abrasive particles contained in the abrasive blade layer 2 are not limited to diamond particles but can be particles of cubic boron nitride or a combination of particles of diamond and cubic boron nitride. The volume fraction of the abrasive particles contained in the abrasive blade layer 2 is an important factor affecting the performance of the cutting wheels of the inventive assembly. Namely, the volume fraction of the abrasive particles in the layer 2 is in the range from 10% to 50%. When the volume fraction of the abrasive particles is too low, the cutting wheels cannot exhibit full cutting performance due to the deficiency in the number of the abrasive particles contributing to cutting so that the efficiency of the cutting works is unduly decreased as a consequence of the decrease in the cutting rate. When the volume fraction of the abrasive particles in the abrasive blade layer is too high, on the other hand, the abrasive particles may be subject to eventual falling from the blade due to the deficiency in the amount of the bonding agent by which the abrasive particles are bonded together, in particular, during the cutting work of a workpiece of high hardness such as a sintered rare earth magnet.

The particle size of the abrasive particles contained in the abrasive blade layer is also of some importance for the performance of the multiple cutting wheel assembly of the invention. According to the results of the extensive investigations in this regard, the abrasive particles should have an average particle diameter in the range from 50 $\mu$m to 250 $\mu$m. When the average particle diameter of the abrasive particles is too small, the surface of the abrasive blade layer would be subject to early clogging with the cutting dust because of the small height of protrusion of the abrasive particles on the surface of the blade layer so that the efficiency in the cutting works is greatly decreased. When the abrasive particles are too coarse, on the other hand, the surface of the abrasive blade layer is necessarily so coarse that the surface of the workpieces formed by cutting is also roughened requiring an elaborated subsequent polishing treatment along with a problem that the thickness of the abrasive blade layer and hence thickness of the cutting wheel cannot be as small as desired even by the use of a base wheel having a very small thickness.

Figure 1C:
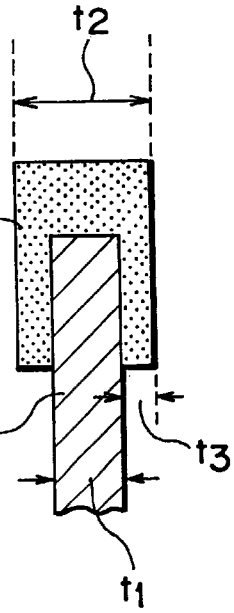
FIG. 1C is an enlargement of FIG. 1B showing the abrasive blade layer on the outer periphery of the base wheel.

As to the thickness t2 of the abrasive blade layer 2 (see FIG. 1C), it has been discovered that the thickness t2 of the abrasive blade layer 2 should be larger by 0.02 to 0.4 mm than the thickness t1 of the base wheel 1, which is in the range from 0.1 to 1 mm, so that the thickness t3 of the escape is in the range from 0.01 to 0.2 mm on each side of the base wheel 1. When the thickness t3 of the escape is too small, the cutting dust particles are readily jammed between the base wheel 1 and the surface of the workpiece under cutting to disturb further cutting works though with little scratches on the base wheel. When the thickness t3 of the escape is too large consequently with a large thickness t2 of the abrasive blade layer 2, the material loss of the workpiece by cutting is increased so much though freed from the problem of jamming of the cutting dust particles.

Needless to say, any small warping or undulation in the base wheel 1 adversely affect the dimensional accuracy of the products obtained by cutting or slicing a workpiece consequently with an increase in the material loss by cutting. Warping or undulation of a base wheel occurs more frequently and more extensively as the thickness of the base wheel is decreased and as the diameter of the base wheel is increased to cause larger difficulties in the preparation thereof. In this regard, the base wheel in the inventive assembly made from a cemented metal carbide is advantageous as compared with other conventional materials for base wheels of a cutting wheel. As a result of the detailed studies on the thickness and diameter which the base wheel should have, a conclusion has been reached that the base wheel should have an outer diameter not exceeding 200 mm and a thickness in the range from 0.1 mm to 1 mm so that a base wheel having good dimensional accuracy and without warping or undulation can be obtained with good reproducibility. A base wheel having an outer diameter exceeding 200 mm or a base wheel having a thickness smaller than 0.1 mm, even though with an outer diameter not exceeding 200 mm, is subject to occurrence of large warping even by preparation from a cemented metal carbide. A base wheel having a thickness exceeding 1 mm, which could be prepared also from a conventional alloy tool steel, has a disadvantage of too large material loss of the workpiece when the cutting work is conducted with a multiple cutting wheel assembly assembled from a plurality of cutting wheels made of such a base wheel of large thickness not to meet the object of the present invention. Needless to say, a base wheel having an outer diameter exceeding 200 mm is too expensive to be suitable for practical applications while a base wheel having a thickness smaller than 0.1 mm is readily cracked or broken in the course of the cutting works.

The abrasive-bladed multiple cutting wheel assembly is of course useful for cutting or slicing any hard and brittle materials but is particularly advantageous when used for machining production of permanent magnets of a sintered rare earth-based alloy or, more particularly, of the magnet allots of the rare earth-iron-boron types consisting of, usually, from 5 to 40% of a rare earth metal or metals, from 50 to 90% of iron and from 0.2 to 8% of boron in weight fractions although it is optional with an object to further improve the magnetic properties and corrosion resistance of the magnets to add a limited amount of one or more of additional elements including carbon, aluminum, silicon, titanium, vanadium, chromium, manganese, cobalt, nickel, copper, zinc, gallium, zirconium, niobium, molybdenum, silver, tin, hafnium, tantalum and tungsten. The amount of these additive elements is usually not exceeding 8% by weight of the overall alloy composition, although the amount of cobalt can be as large as up to 30% by weight, since addition of the additive elements in an excessively large amount has an adverse effect to decrease the magnetic properties of the magnets.

Permanent magnets of the above mentioned sintered rare earth-iron-boron magnet alloy can be prepared according to a conventional powder metallurgical process in which the respective constituents in the elementary forms taken in a specified weight proportion are melted together into a melt of the alloy, the melt is cast to give an ingot of the alloy, the ingot is finely pulverized into particles having an average particle diameter of 1 to 20 $\mu$m, the alloy powder is shaped by compression molding into a green body in a magnetic field and finally the green body of the alloy powder is subjected to a heat treatment to effect sintering and aging first at a temperature of 1000 to 1200° C. for 0.5 to 5 hours and then at 400 to 1000° C.

The above described abrasive-bladed multiple cutting wheel assembly according to the invention, which is an assembly of a plurality of outer-bladed cutting wheels each constructed with a base wheel made from a cemented metal carbide satisfying the requirement for the Young's modulus of 45000 to 70000 kgf/mm$^2$ or Vickers hardness Hv of 900 to 2000 or desirably satisfying the requirements for both of these two parameters and shaped into an annular disk, can be used advantageously in the cutting or slicing works of a hard and brittle material such as sintered rare earth-based permanent magnets in respect of the cutting accuracy and durability with stability despite the relatively small thickness of the base wheels to contribute to the improvement of the costs for the cutting works, and productivity with an outstandingly decreased material loss by cutting.

In the following, the abrasive-bladed multiple cutting wheel assembly of the invention is described in more detail by way of Examples and Comparative Examples, which, however, never limit the scope of the invention in any way.

EXAMPLE 1

A cemented metal carbide consisting of 90% by weight of tungsten carbide and 10% by weight of cobalt having a Young's modulus of 62000 kgf/mm$^2$ was shaped into an annular disk having an outer diameter of 115 mm, inner diameter of 40 mm and thickness of 0.4 mm as a base wheel of an abrasive-bladed cutting wheel. An abrasive blade layer of diamond particles was formed on and around the outer periphery of the base wheel by the resin-bond method in the following manner. Thus, the base wheel was set in a metal mold and the gap space around the base wheel was filled with an abrasive blend composed of 25% by volume of diamond particles having an average particle diameter of 150 $\mu$m and 75% by volume of particles of a heat-curable phenolic resin followed by pressing into the form of an abrasive-bladed cutting wheel and curing of the phenolic resin in situ at 180° C. for 2 hours. After cooling, the cutting wheel was taken out of the metal mold and finished on a lapping machine to give an abrasive blade layer having a thickness of 0.5 mm. Two cutting wheels were prepared in the above described manner.

The abrasive-bladed cutting wheels were assembled into a double-blade cutting wheel assembly by mounting them on a shaft of 40 mm diameter keeping a spacing of 1.6 mm by using a spacer of 1.6 mm thickness having an outer diameter of 80 mm and inner diameter of 40 mm. A cutting test was undertaken for this double-blade assembly rotated at 5000 rpm with a sintered block of a neodymium-iron-boron permanent magnet alloy as the workpiece. The cutting rate was 12 mm/minute and the cutting area had a width of 40 mm and a depth of 15 mm to give a magnet plate in each cutting run with a target thickness of the magnet plates of 1.50 mm and a control limit of ±0.05 mm.

Figure 3:
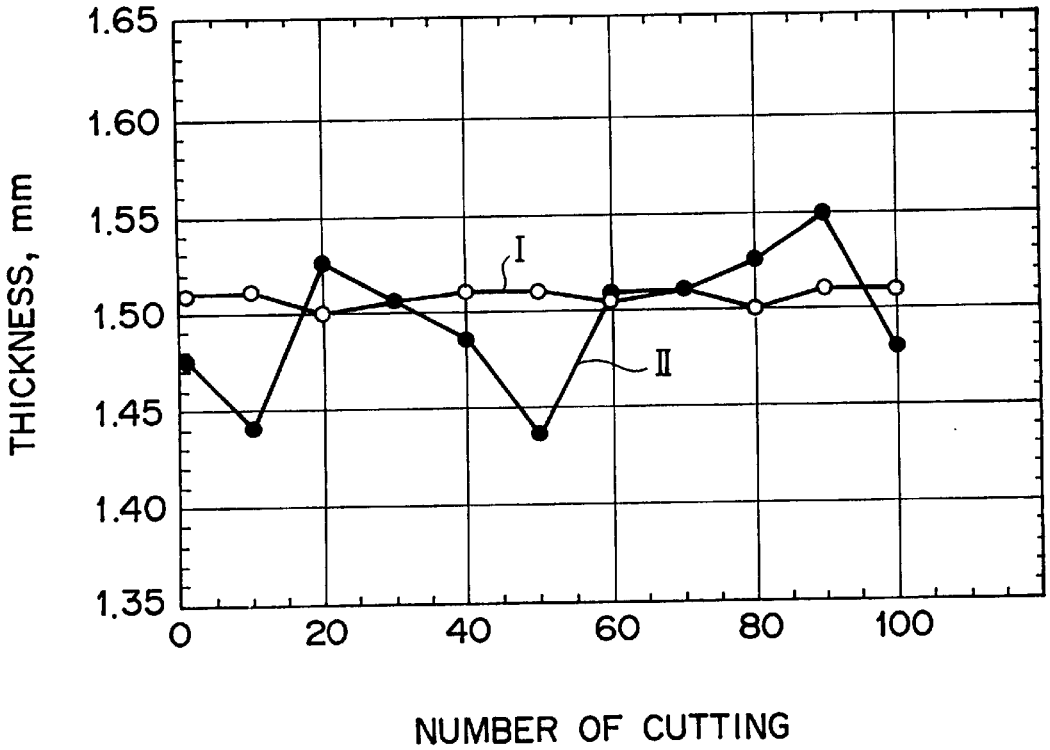
FIG. 3 is a graph showing the accuracy of cutting thickness as a function of the number of pieces as cut making comparison between Example 1 and Comparative Example 1.

The cutting works of 100 runs were conducted in the above described manner and measurement of the thickness of the magnet plate obtained in every tenth cutting run was measured by using a micrometer caliper at about the center point of the magnet plate to give the results shown by the polygonal line I in FIG. 3, in which the data plotted at the left end of the polygonal line I are for the product obtained in the first cutting run.

As is understood from this graph, the magnet plates obtained in this cutting test each had a thickness well within the control limit of the target value without necessitating any adjustment of the spacer thickness.

Comparative Example 1

The experimental procedure was substantially the same as in Example 1 excepting for the replacement of the base wheel made from a cemented metal carbide in each cutting wheel with a base wheel of the same dimensions made from a conventional alloy tool steel of the grade SKD. The results of the thickness measurement of the magnet plates are shown by the polygonal line II in FIG. 3. When the thickness as measured fell outside the control limit, adjustment of the spacer thickness was undertaken for an increment of 100 $\mu$m, an increment of 100 $\mu$m and a decrement of 50 $\mu$m after 10th, 50th and 90th runs, respectively.

EXAMPLE 2

Another cemented metal carbide consisting of 85% by weight of tungsten carbide and 15% by weight of cobalt having a Young's modulus of 55000 kgf/mm$^2$ was shaped into an annular disk having an outer diameter of 125 mm, inner diameter of 40 mm and thickness of 0.5 mm as a base wheel of an abrasive-bladed cutting wheel. An abrasive blade layer of diamond particles was formed on and around the outer periphery of the base wheel with an abrasive blend composed of 20% by volume of diamond particles having an average particle diameter of 120 $\mu$m and 80% by volume of particles of a heat-curable phenolic resin to give an abrasive blade layer having a thickness of 0.6 mm. Thirty-one abrasive-bladed cutting wheels were prepared in the above described manner.

The thus prepared abrasive-bladed cutting wheels were assembled into a 31-blade cutting wheel assembly on a shaft of 40 mm diameter each separated from the adjacent wheels with intervention of a 1.1 mm thick spacer having an outer diameter of 80 mm and inner diameter of 40 mm.

A cutting test was undertaken with the thus prepared multiple cutting wheel assembly rotated at 6000 rpm for a sintered rare earth-based magnet block of the neodymium-iron-boron type having 50 mm by 30 mm by 20 mm dimensions in the cutting direction perpendicular to the 50 mm-long side at a cutting rate of 15 mm/minute to give 30 magnet plates of 30 mm by 20 mm area in a single cutting run with a target thickness of 1.0 mm and a control limit of ±0.05 mm. This test cutting run was repeated for 1000 blocks to produce 30000 magnet plates, each of which was subjected to the measurement of thickness at about the center point to find that all of the thus produced magnet plates had a thickness within the control limit of 1.0±0.05 mm without necessitating any adjustment of the spacer thickness and replacement of the cutting wheels. The material yield by cutting was 60%.

Comparative Example 2

The experimental procedure was substantially the same as in Example 2 described above excepting for the replacement of the base wheels made from a cemented metal carbide with base wheels of the same dimensions made from a high speed steel of the grade SKH.

The result of the test cutting runs was that the desired thickness of the 30000 magnet plates could be kept within the control limit only by undertaking 118 times as a total of the spacer thickness adjustment and 27 times of replacement of the cutting wheels each with a freshly prepared cutting wheel, where the spacer thickness adjustment was undertaken when the thickness of the magnet plate as cut with the wheels sandwiching the spacer did not fall within the control limit and replacement of the cutting wheels was undertaken when the desired thickness of the magnet plate within the control limit could not be obtained even after 3 times of spacer thickness adjustment necessitated at the same cutting wheels. The material yield by cutting was 60%.

Comparative Example 3

The experimental procedure was substantially the same as in Comparative Example 2 except that each of the base wheels of SKH steel had a thickness of 0.9 mm and the abrasive blade layer of the abrasive-bladed cutting wheels had a thickness of 1.0 mm. In accordance with the increase in the thickness of the cutting wheels, the multiple cutting wheel assembly was prepared by assembling 25 cutting blades instead of 31 cutting blades so that 24 magnet plates could be obtained in a single cutting run.

The result of the test cutting runs was that the desired thickness of the 24000 magnet plates could be kept within the control limit only by undertaking 15 times as a total of the spacer thickness adjustment and 2 times of replacement of the cutting wheels each with a freshly prepared cutting wheel. The material yield by cutting was 48%.

EXAMPLE 3

A cemented metal carbide consisting of 80% by weight of tungsten carbide and 20% by weight of cobalt having a Young's modulus of 50000 kgf/mm$^2$ was shaped into an annular disk having an outer diameter of 100 mm, inner diameter of 40 mm and thickness of 0.3 mm as a base wheel of an abrasive-bladed cutting wheel. An abrasive blade layer of abrasive particles, which was a 1:1 by weight combination of artificial diamond particles and cubic boron nitride particles having an average particle diameter of 100 $\mu$m, was formed on and around the outer periphery of the base wheel by the metal-bond method in the following manner. Thus, the base wheel was set in a metal mold and the gap space around the base wheel was filled with an abrasive blend composed of 15% by volume of the abrasive particles and 85% by volume of particles of a binder metal followed by pressing into the form of an abrasive-bladed cutting wheel and calcination thereof at 700° C. for 2 hours. After cooling, the wheel was finished on a lapping machine to give a form of an abrasive blade layer having a thickness of 0.4 mm. Two abrasive-bladed cutting wheels were prepared in the above described manner.

Figure 4:
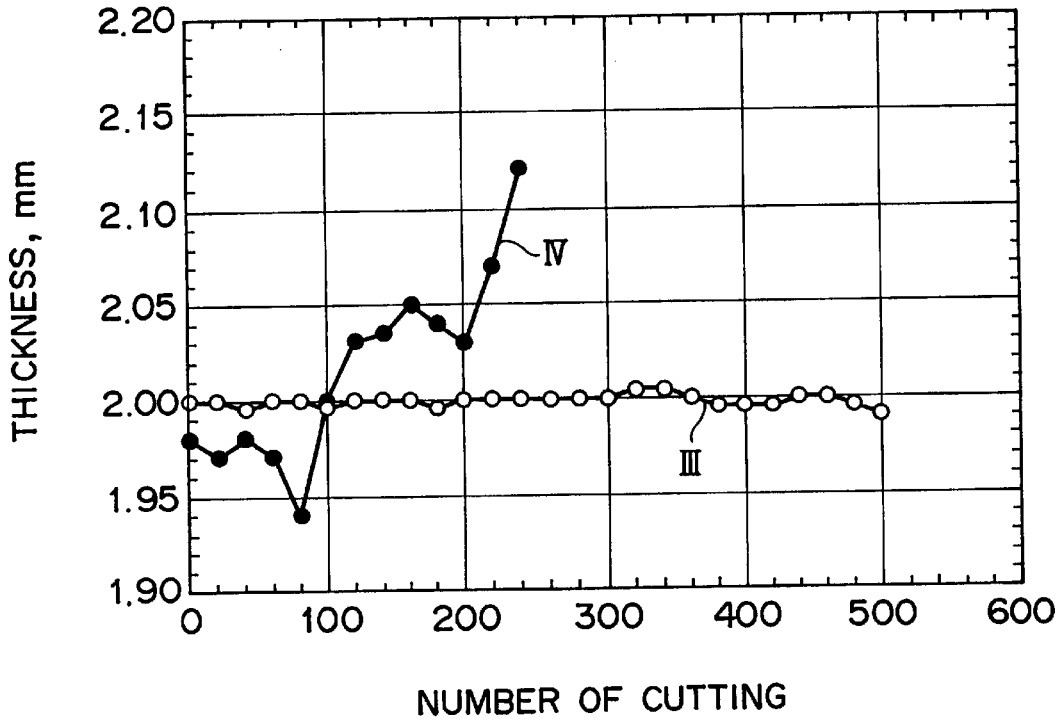
FIG. 4 is a graph showing the accuracy of cutting thickness as a function of the number of pieces as cut making comparison between Example 3 and Comparative Example 4.

A cutting test of a sintered rare earth magnet block was conducted in the same manner as in Example 1 by using a double-blade cutting wheel assembly constructed with the above prepared two cutting wheels assembled on a shaft of 40 mm diameter with a spacer having an outer diameter of 75 mm, inner diameter of 40 mm and thickness of 2.1 mm intervening between the two cutting wheels. The cutting wheel assembly was rotated at 5500 rpm and the cutting rate into the magnet block was 8 mm/minute with a cutting area of 50 mm by 10 mm. The target thickness of cutting was 2.0 mm with a control limit of ±0.05 mm. The result of the cutting test undertaken for 500 magnet blocks was so satisfactory, as is shown by the polygonal line III in FIG. 4, that the thickness of the magnet plates each taken in every 20th run of cutting up to 500 runs could be kept within the control limit without necessitating any spacer thickness adjustment. The data plotted at the left end of the polygonal line III are for the magnet plate obtained in the first cutting run.

Comparative Example 4

The experimental procedure was substantially the same as in Example 3 described above except that the cutting wheels were each prepared by using a base wheel made from a high speed steel SKH instead of the cemented metal carbide. The result of the cutting test was that adjustment of the spacer thickness with an increment of 50 $\mu$m was necessitated after 30 times of the repeated cutting runs in order to keep the thickness of the magnet plates within the control limit. The test cutting runs could not be continued to exceed 240 runs due to an undue increase in the cutting resistance and an uncontrollable deviation of the product thickness as is shown by the polygonal line IV in FIG. 4.

EXAMPLE 4

A cemented metal carbide consisting of 90% by weight of tungsten carbide and 10% by weight of cobalt and having a Vickers hardness Hv of 1500 was shaped into an annular disk as a base wheel having an outer diameter of 115 mm, inner diameter of 40 mm and thickness of 0.3 mm. An abrasive blade layer of diamond particles having a thickness of 0.4 mm was formed on and around the outer periphery of the base wheel by the resin-bond method in the same manner as in Example 1 from an abrasive blend composed of 25% by volume of artificial diamond particles having an average particle diameter of 150 $\mu$m and 75% by volume of particles of a heat-curable phenolic resin. Twenty-seven cutting wheels were prepared in the above described manner.

A multiple cutting wheel assembly was constructed from these 27 cutting wheels assembled on a shaft of 40 mm diameter each separated from the adjacent ones by sandwiching a spacer having an outer diameter of 80 mm, inner diameter of 40 mm and thickness of 1.6 mm. A cutting test was undertaken with this multiple cutting wheel assembly rotated at 6000 rpm for a sintered rare earth magnet block of 50 mm by 30 mm by 15 mm dimensions at a cutting rate of 22 mm/ minute so as to obtain 26 magnet plates in a single cutting run. The target thickness of the magnet plate products was 1.5 mm with a control limit of ±0.05 mm.

The result of the cutting test conducted for 1000 cutting runs was quite satisfactory since all of the magnet plate products could have a thickness falling within the control limit of the target thickness without necessitating any adjustment of the spacer thickness and replacement of the cutting wheels with fresh ones.

Comparative Example 5

The experimental procedure was substantially the same as in Example 4 except that the base wheels were made from an alloy tool steel SKD instead of the cemented metal carbide.

The result of the cutting test was that 16 times, 28 times, 45 times, 61 times and 92 times each as a total of spacer thickness adjustment were necessary before completion of 200, 400, 600, 800 and 1000 cutting runs, respectively, and 3 times, 7 times, 12 times, 19 times and 26 times each as a total of replacement of the cutting wheels were necessary before completion of 200, 400, 600, 800 and 1000 cutting runs, respectively.

EXAMPLE 5

Another cemented metal carbide consisting of 85% by weight of tungsten carbide and 15% by weight of cobalt having a Vickers hardness Hv of 1250 was shaped into an annular disk having an outer diameter of 125 mm, inner diameter of 40 mm and thickness of 0.4 mm as a base wheel of an abrasive-bladed cutting wheel. An abrasive blade layer of diamond particles was formed on and around the outer periphery of the base wheel with an abrasive blend composed of 20% by volume of diamond particles having an average particle diameter of 120 $\mu$m and 80% by volume of particles of a heat-curable phenolic resin to form an abrasive blade layer having a thickness of 0.5 mm. Thirty-four abrasive-bladed cutting wheels were prepared in the above described manner.

The thus prepared abrasive-bladed cutting wheels were assembled into a 34-blade cutting wheel assembly on a shaft of 40 mm diameter each separated from the adjacent wheels with intervention of a 1.1 mm thick spacer having an outer diameter of 80 mm and inner diameter of 40 mm.

A cutting test was undertaken with the thus prepared multiple cutting wheel assembly rotated at 5500 rpm for a sintered rare earth-based magnet block of the neodymium-iron-boron type having 50 mm by 30 mm by 20 mm dimensions in the same manner as in Example 2 at a cutting rate of 15 mm/minute to give 33 magnet plates of 30 mm by 20 mm dimensions in a single cutting run with a target thickness of 1.0 mm and a control limit of ±0.05 mm. This test cutting run was repeated for 1000 blocks to produce 33000 magnet plates, each of which was subjected to the measurement of thickness at about the center point to find that all of the thus produced magnet plates had a thickness within the control limit of 1.0±0.05 mm without necessitating any adjustment of the spacer thickness and replacement of the cutting wheels. The material yield by cutting was 66%.

Comparative Example 6

The experimental procedure was substantially the same as in Example 5 described above excepting for the replacement of the base wheels made from a cemented metal carbide of a Vickers hardness Hv of 1250e with base wheels of the same dimensions made from another cemented metal carbide having a Vickers hardness Hv of 800.

The result of the test cutting runs was that the desired thickness of the 33000 magnet plates could be kept within the control limit only by undertaking 28 times as a total of the spacer thickness adjustment and 4 times of replacement of the cutting wheels each with a freshly prepared cutting wheel. The material yield by cutting was 66%.

Comparative Example 7

The experimental procedure was substantially the same as in Example 5 described above excepting for the replacement of the base wheels made from a cemented metal carbide of a Vickers hardness Hv of 1250 with base wheels made from an alloy tool steel SKD having a thickness of 0.9 mm and increase in the thickness of the abrasive blade layer from 0.5 mm to 1.0 mm. Further, the multiple cutting wheel assembly was constructed from 25 cutting wheels so that 24 magnet plates could be obtained in a single cutting run.

The result of the test cutting runs was that the desired thickness of the 24000 magnet plates could be kept within the control limit only by undertaking 31 times as a total of the spacer thickness adjustment and 6 times of replacement of the cutting wheels each with a freshly prepared cutting wheel. The material yield by cutting was 48%.

EXAMPLE 6

Another cemented metal carbide consisting of 80% by weight of tungsten carbide and 20% by weight of cobalt having a Vickers hardness Hv of 1100 was shaped into an annular disk having an outer diameter of 105 mm, inner diameter of 40 mm and thickness of 0.3 mm as a base wheel of an abrasive-bladed cutting wheel. An abrasive blade layer of abrasive particles was formed on and around the outer periphery of the base wheel by the metal bond method from a mixture consisting of 85% by volume of a binder metal consisting of 70% by weight of copper and 30% by weight of tin and 15% by volume of a 1:1 by weight blend of diamond particles and particles of cubic boron nitride having an average particle diameter of 100 $\mu$m. Press-forming of the blade was followed by a heat treatment at 700° C. for 2 hours to give an abrasive blade layer having a thickness of 0.4 mm. Thirty-two abrasive-bladed cutting wheels were prepared in the above described manner.

The thus prepared abrasive-bladed cutting wheels were assembled into a 32-blade cutting wheel assembly on a shaft of 40 mm diameter each separated from the adjacent wheels with intervention of a 1.3 mm thick spacer having an outer diameter of 75 mm and inner diameter of 40 mm.

A cutting test was undertaken with the thus prepared multipleblade cutting wheel assembly rotated at 8000 rpm for a sintered rare earth-based magnet block of the neodymium-iron-boron type having 50 mm by 30 mm by 10 mm dimensions in the cutting direction perpendicular to the 50 mm-long side at a cutting rate of 25 mm/minutes to give 31 magnet plates of 30 mm by 10 mm area in a single cutting run with a target thickness of 1.2 mm and a control limit of ±0.05 mm. This test cutting run was repeated for 1000 blocks to produce 31000 magnet plates, each of which was subjected to the measurement of thickness at about the center point to find that all of the thus produced magnet plates had a thickness within the control limit of 1.2±0.05 mm without necessitating any adjustment of the spacer thickness and replacement of the cutting wheels.

Comparative Example 8

The experimental procedure was substantially the same as in Example 6 described above excepting for the replacement of the base wheels made from a cemented metal carbide with base wheels of the same dimensions made from a high speed steel of the grade SKH.

The result of the test cutting runs was that the desired thickness of the 31000 magnet plates obtained by cutting of 1000 magnet blocks could be kept within the control limit only by undertaking 22 times, 41 times, 78 times, 125 times and 161 times each as a total of the spacer thickness adjustment and 4 times, 11 times, 18 times, 36 times and 47 times each as a total of replacement of the cutting wheels each with a freshly prepared cutting wheel for completion of cutting of the first 200 blocks, first 400 blocks, first 600 blocks, first 800 blocks and the total of 1000 blocks, respectively.

What is claimed is:

1. An abrasive-bladed multiple cutting wheel assembly which comprises:

(A) a shaft for rotation;

(B) at least two abrasive-bladed cutting wheels each consisting of a base wheel having a center opening for insertion of the shaft and an abrasive blade layer bonded to the outer periphery of the base wheel, each cutting wheel being fixed on the shaft inserted into the center opening therein; and (C) at least one spacer, the number of the spacers being smaller by one than the number of the abrasive-bladed cutting wheels, having a center opening for insertion of the shaft and fixed on the shaft by inserting the shaft into the center opening at a position between two abrasive-bladed cutting wheels to define the spacing therebetween, the base wheel of the abrasive-bladed cutting wheel being made from a cemented metal carbide having a Young's modulus in the range from 45000 to 70000 kgf/mm$^2$ and the abrasive blade layer of the abrasive-bladed cutting wheel being made from particles of an abrasive material bonded together with a bonding agent.

2. The abrasive-bladed multiple cutting wheel assembly as claimed in claim 1 in which the cemented metal carbide has a Vickers hardness Hv in the range from 900 to 2000.

3. The abrasive-bladed multiple cutting wheel assembly as claimed in claim 1 in which the cemented metal carbide is tungsten carbide cemented with cobalt.

4. The abrasive-bladed multiple cutting wheel assembly as claimed in claim 1 in which the base wheel has a thickness in the range from 0.1 to 1 mm and an outer diameter not exceeding 200 mm.

5. The abrasive-bladed multiple cutting wheel assembly as claimed in claim 1 in which the number of the abrasive-bladed cutting wheels is in the range from 3 to 200.

6. The abrasive-bladed multiple cutting wheel assembly as claimed in claim 1 in which the abrasive blade layer contains from 10 to 50% by volume of the abrasive particles, the balance being the bonding agent.

7. The abrasive-bladed multiple cutting wheel assembly as claimed in claim 1 in which the abrasive particles contained in the abrasive blade layer are particles of diamond, particles of cubic boron nitride or a combination thereof.

8. The abrasive-bladed multiple cutting wheel assembly as claimed in claim 7 in which the abrasive particles have an average particle diameter in the range from 50 to 250 $\mu$m.

* * * * *